US008708199B2

(12) United States Patent
James

(10) Patent No.: US 8,708,199 B2
(45) Date of Patent: Apr. 29, 2014

(54) BULK DISPENSING SYSTEM AND METHOD

(76) Inventor: Mark Edward James, Santa Cruz, CA (US)

( * ) Notice: Subject to any disclaimer, the term of this patent is extended or adjusted under 35 U.S.C. 154(b) by 287 days.

(21) Appl. No.: 13/212,165

(22) Filed: Aug. 17, 2011

(65) Prior Publication Data

US 2012/0199244 A1 Aug. 9, 2012

Related U.S. Application Data

(60) Provisional application No. 61/462,731, filed on Feb. 7, 2011, provisional application No. 61/463,127, filed on Feb. 14, 2011, provisional application No. 61/571,239, filed on Jun. 23, 2011.

(51) Int. Cl.

| | |
|---|---|
| ***B67D 7/56*** | (2010.01) |
| ***B65D 47/10*** | (2006.01) |
| ***B65D 35/56*** | (2006.01) |
| ***B67D 3/00*** | (2006.01) |
| ***B67D 7/06*** | (2010.01) |

(52) U.S. Cl.

USPC ..... 222/158; 222/541.6; 222/541.9; 222/105; 222/513; 222/514

(58) Field of Classification Search

USPC ..... 222/158, 461, 529, 541.6, 541.9, 207, 222/105, 513, 514, 518, 525, 449, 450, 453, 222/181.1; 383/205, 207, 208, 209, 200, 383/67, 906; 206/554; 141/363, 364, 365, 141/366

See application file for complete search history.

(56) References Cited

U.S. PATENT DOCUMENTS

| | | | | |
|---|---|---|---|---|
| 352,195 | A | | 11/1886 | Krag |
| 548,768 | A | * | 10/1895 | Wells ..... 222/189.06 |
| 2,023,151 | A | | 11/1933 | Sebell |
| 2,862,645 | A | | 12/1958 | Page et al. |
| 3,145,858 | A | | 8/1964 | Helbig |
| 3,399,760 | A | * | 9/1968 | Hechler, IV ..... 383/207 |
| 3,658,216 | A | | 4/1972 | Schwartzman |
| 3,999,654 | A | * | 12/1976 | Pollack ..... 206/216 |
| 4,364,478 | A | | 12/1982 | Tuns |
| 4,562,940 | A | * | 1/1986 | Asphar ..... 222/88 |
| 4,562,941 | A | | 1/1986 | Sanfilippo |
| 4,627,476 | A | * | 12/1986 | Wilcke ..... 141/364 |
| 4,703,782 | A | | 11/1987 | Henkel |
| 4,790,457 | A | | 12/1988 | Morse et al. |
| 4,802,609 | A | | 2/1989 | Morse et al. |
| 4,877,139 | A | | 10/1989 | Kim |

(Continued)

*Primary Examiner* — Paul R Durand
*Assistant Examiner* — Benjamin R Shaw
(74) *Attorney, Agent, or Firm* — Intellectual Property Law Group LLP

(57) ABSTRACT

A unified system, device and method for bulk dispensing a product in a safe and sanitary environment preventing micro and macro contamination, adulteration and product mix-up. The system comprises a bulk product dispenser having a discharge valve; a container/bag holding to-be-dispensed product in a UV-proof, fluid-impermeable, sealed environment, having a tear-tab adapted for releasing the product from outside the dispenser; and a containment device removably attachable with the discharge valve which measures and dispenses the product to the consumer. A containment device for bulk product dispensing comprises an inner containment receiving the product, having an inner tube, first coupling, bottom opening, and second coupling aligned with the bottom opening; and an outer valve portion enclosing the inner containment, comprising an outer tube, cap, spring and bottom closure with aperture(s), the spring between the first coupling and the cap, and providing resistance keeping the bottom closure against the second coupling.

6 Claims, 7 Drawing Sheets

(56) References Cited

U.S. PATENT DOCUMENTS

| | | | | |
|---|---|---|---|---|
| 4,953,729 | A * | 9/1990 | Kloosterhouse | 215/255 |
| 5,139,173 | A | 8/1992 | Evinger | |
| 5,373,872 | A * | 12/1994 | Mueller | 141/10 |
| 5,470,419 | A * | 11/1995 | Sasaki et al. | 156/244.12 |
| 5,560,519 | A | 10/1996 | Moore et al. | |
| 5,642,834 | A | 7/1997 | Shaw et al. | |
| 5,650,841 | A * | 7/1997 | Matsuda et al. | 399/111 |
| 5,667,108 | A | 9/1997 | Braun et al. | |
| 5,685,460 | A | 11/1997 | Vlastuin | |
| 5,730,333 | A | 3/1998 | Baluk et al. | |
| 5,730,334 | A * | 3/1998 | Mizrahi | 222/185.1 |
| 5,826,754 | A | 10/1998 | Ishaya et al. | |
| 5,833,097 | A | 11/1998 | Ruth | |
| 5,988,491 | A | 11/1999 | Morrison | |
| 6,056,157 | A | 5/2000 | Gehl et al. | |
| 6,126,318 | A * | 10/2000 | Bell | 383/209 |
| 6,158,623 | A | 12/2000 | Benavides et al. | |
| 6,182,864 | B1 * | 2/2001 | Elmore | 222/129 |
| 6,199,724 | B1 | 3/2001 | Yeranossian | |
| 6,241,123 | B1 * | 6/2001 | Elmore | 222/129 |
| 6,257,464 | B1 | 7/2001 | Dalton et al. | |
| 6,276,572 | B1 | 8/2001 | Evans | |
| 6,488,184 | B2 | 12/2002 | Hammer et al. | |
| 6,530,403 | B2 * | 3/2003 | McGregor et al. | 141/264 |
| 6,702,154 | B2 * | 3/2004 | Ellis | 222/185.1 |
| 6,786,394 | B2 | 9/2004 | Prince | |
| 6,868,988 | B2 | 3/2005 | Ufheil et al. | |
| 7,178,697 | B2 * | 2/2007 | Brundick et al. | 222/181.1 |
| RE41,267 | E | 4/2010 | Reinsch et al. | |
| 7,832,598 | B2 | 11/2010 | Rode et al. | |
| 2003/0051440 | A1 * | 3/2003 | Chow et al. | 53/412 |
| 2006/0186138 | A1 | 8/2006 | Brundick | |
| 2006/0191958 | A1 * | 8/2006 | Brundick | 222/158 |
| 2006/0269174 | A1 * | 11/2006 | Huffer | 383/207 |
| 2008/0023104 | A1 * | 1/2008 | Steinweg | 141/344 |
| 2008/0099509 | A1 | 5/2008 | Mountjoy | |
| 2009/0020559 | A1 | 1/2009 | Sanfilippo et al. | |
| 2009/0039098 | A1 | 2/2009 | Karwacki | |
| 2010/0012550 | A1 | 1/2010 | Dedmon et al. | |
| 2010/0193074 | A1 | 8/2010 | Bohler | |
| 2010/0282770 | A1 | 11/2010 | Mendes et al. | |
| 2011/0062187 | A1 | 3/2011 | Johnson et al. | |
| 2011/0062190 | A1 | 3/2011 | Johnson et al. | |

* cited by examiner

BULK DISPENSING SYSTEM AND METHOD

CROSS-REFERENCE TO RELATED APPLICATIONS

This application claims priority under 35 U.S.C. §119(e) to U.S. Provisional Application No. 61/462,731 filed Feb. 7, 2011; U.S. Provisional Application No. 61/463,127 filed Feb. 14, 2011; and U.S. Provisional Application No. 61/571,239 filed on Jun. 23, 2011; all of which are hereby incorporated by reference for all purposes.

BACKGROUND

1. Field of Invention

This invention relates to a system, device and method of dispensing bulk products, where the dispensed product is protected from the micro and macro contamination of movement, transportation and storage by the manufacturer, the retailer, and consumers. More particularly, the system and method involves a unified multi-part system comprising of a bulk product dispenser, product container/bag with quick release and a secondary containment/calibration device.

2. Background

Bulk product dispensing units are predominant in the retail marketplace, and especially for foods. A significant challenge with most scoop and gravity feed bulk bins for foods and dietary supplements, is the likelihood of micro and macro contamination of the dispensed product. This contamination can be as benign as inadvertently mixing Gummy Bears with other candies, but exemplifies the problem that current bulk food dispensers are open, and their contents are exposed to the retail environment. This exposes the unpackaged food or product to potential micro and macro contamination, as well as potential exposure to infestation by insects or rodents, as well as potential adulteration or product mix-up.

Although food retailers must comply with the various Hazard Analysis Critical Control Point (HACCP) sanitary standards and regulations promulgated by various state and local Health Departments, they are generally exempt from Federal Good Manufacturing Practices (GMPs). The challenge for retailers is that their GMP exemptions may not provide them with protection from potentially exposing their consumers to contaminated or infested bulk-dispensed products. Additionally, current bulk-dispensers and systems are not compliant with current GMPs for dietary supplements, medical foods or drugs.

Accordingly, a need exists to provide retailers a bulk product dispensing system and method that safely dispenses bulk-dispensed foods, supplements and drugs to consumers free from exposure to the retail environment with its potential for contamination, adulteration and product mix-up.

Accordingly, a need exists for safer and cleaner dispensing of gravity fed products in a calibrated manner to consumers, allowing for visual inspection of the product and free from potential contamination, adulteration and product mix up of the retail environment.

SUMMARY

The bulk product dispenser in accordance with an embodiment of the present invention is a unified storage, calibration and dispensing system and method. The innovative bulk product dispensing system and method create an environment where the preservation, measuring and dispensing process of foods, drugs, and dietary supplements will limit micro and macro contamination, adulteration, product mix-up and infestation. The system and method is designed for use with bulk dispensed foods, medical foods, drugs and dietary supplements in a clean and contained environment enabling compliance with the Food, Drug and Cosmetic Act and current Good Manufacturing Practices.

According to an embodiment, the bulk product dispensing system comprises a gravity feed bulk product dispenser, a product container and a secondary product containment unit. The bulk product dispenser comprises a hopper and a discharge valve, the dispenser holds a bulk product-filled container. The product container comprises a tear-tab that extends to the outside of the bulk product dispenser and can be torn open from the outside of the dispenser without the need to place human hands inside the dispenser. The bulk product dispenser disgorges bulk food products into a secondary product containment unit. The secondary product containment unit contains and measures the product before final consumer release and dispensation.

According to an embodiment of the present invention there is disclosed a gravity feed bulk product dispensing system comprising: a bulk product dispenser comprising a discharge valve at a bottom of the dispenser; a product container configured for holding and protecting a product from damaging moisture, ultra violet light and contamination, the product container constructed to fit, in a product-filled state, inside of the bulk product dispenser. The product container further comprises a tear-tab extending from a bottom edge of the container, the tear-tab having an edge coterminous with a sealed tear-opening on the container, wherein drawing on the tear-tab opens the tear-opening and releases the product into the bulk product dispenser and directed toward the discharge valve. There is a secondary product containment unit having an entrance, the entrance adapted to removably attach to the discharge valve, wherein the secondary containment unit further comprises a funnel extending from the entrance, a tubular inner compartment connected to the funnel that receives the product dispensed through the discharge valve and funnel, the inner compartment further comprising a measuring means to measure the product received, and a spring loaded exit valve for disgorging the product.

According to an embodiment of the present invention there is disclosed a gravity feed bulk product dispensing system comprising a bulk product dispenser further comprising a hopper and a discharge valve at the bottom of the dispenser; a product containment bag holding and protecting a product from damaging moisture, ultra violet light and contamination, and positioned inside and configured to fit, in a product-filled state, the bulk product dispenser; and a secondary product containment device, positioned below the bulk product dispenser and connected to the discharge valve; wherein the product containment bag further comprises a sealed tethered edge, a back edge, an open top edge, a closed angled bottom edge and a tear-tab positioned on the bottom of the bag between the tethered edge and the angled bottom edge, said tear-tab when opened, releases product into the bulk product dispenser to be dispensed through the discharge valve; wherein the secondary product containment device further comprises a funnel, a tubular inner containment portion that receives and contains the product dispensed through the discharge valve, said inner containment portion further comprising a measuring means to measure and visually evaluate the product contained inside, and a spring loaded exit valve opening downward to release the contained product.

In another embodiment, there is a bulk product dispensing system comprising: a contained product dispenser for holding a product and having a dispensing valve; a product containment device comprising an inner portion and an exit valve mechanism, said containment device adapted for removable connection to the dispensing valve of the dispenser; said inner portion further comprising a measuring means to measure and visually evaluate the product received inside the inner portion; and the exit valve mechanism further comprising a cap, a bottom closure, an outer tube enclosing the inner portion and positioned between the cap and the bottom closure; wherein the containment device in a normal position receives the product from the dispensing valve into the inner portion when the dispensing valve is engaged, said exit valve mechanism remaining closed in the normal position to receive and measure the product; and wherein when the dispensing valve is disengaged, operating the exit valve mechanism places the containment device in an open position for releasing the product.

In accordance with another embodiment of the present invention, there is product containment device for bulk product dispensing comprising: a funnel having a top and a bottom; an inner containment portion that receives, measures and disgorges a product, said inner containment portion connected to the bottom of the funnel, further comprising an inner tube, a first coupling at a top section of the inner tube, a bottom opening, and second coupling aligned with the bottom opening; and an outer valve portion that encloses the inner containment portion, further comprising an outer tube, a cap, a spring and a bottom closure, said spring positioned between the first coupling and the cap and providing resistance to keep the bottom closure pressed against the second coupling, keeping the bottom opening closed.

According to another embodiment of the present invention, there is further disclosed a method for gravity fed bulk product dispensing using a bulk product dispensing system comprising a product dispenser connected to a secondary product containment unit for dispending a product, the method comprising: loading the dispenser with product sealed within a product containment bag or liner wherein the containment bag is made of protective material against moisture, ultra violet light and air and having a quick release tear tab with a tethered strip; threading the tethered strip of the containment bag through a dispensing valve of the dispenser; attaching the secondary product containment unit to the discharge valve; pulling the tethered strip to release the tear tab allowing product to release from the bag into the dispenser; engaging the discharge valve to dispense and measure product into the containment unit as the containment unit is in a closed state; after releasing the discharge valve of the dispenser such that the dispenser is in a closed off state, engaging the containment unit to release the product to a consumer.

Embodiments of the present invention are disclosed as fully compliant with current US Federal Good Manufacturing Practices for both Foods and Dietary Supplements as well as current Hazard Analysis Critical Control Point procedures promulgated as State and Local health regulations.

These and other aspects of the present invention are further made apparent, in the remainder of the present document, to those of ordinary skill in the art.

BRIEF DESCRIPTION OF THE DRAWINGS

In order to more fully describe embodiments of the present invention, reference is made to the accompanying drawings. These drawings are not to be considered limitations in the scope of the invention, but are merely illustrative.

DETAILED DESCRIPTION OF SPECIFIC EMBODIMENTS

The description above and below and the drawings of the present document focus on one or more currently preferred embodiments of the present invention and also describe some exemplary optional features and/or alternative embodiments. The description and drawings are for the purpose of illustration and not limitation. Those of ordinary skill in the art would recognize variations, modifications, and alternatives. Such variations, modifications, and alternatives are also within the scope of the present invention. Section titles are terse and are for convenience only.

Figure 2:
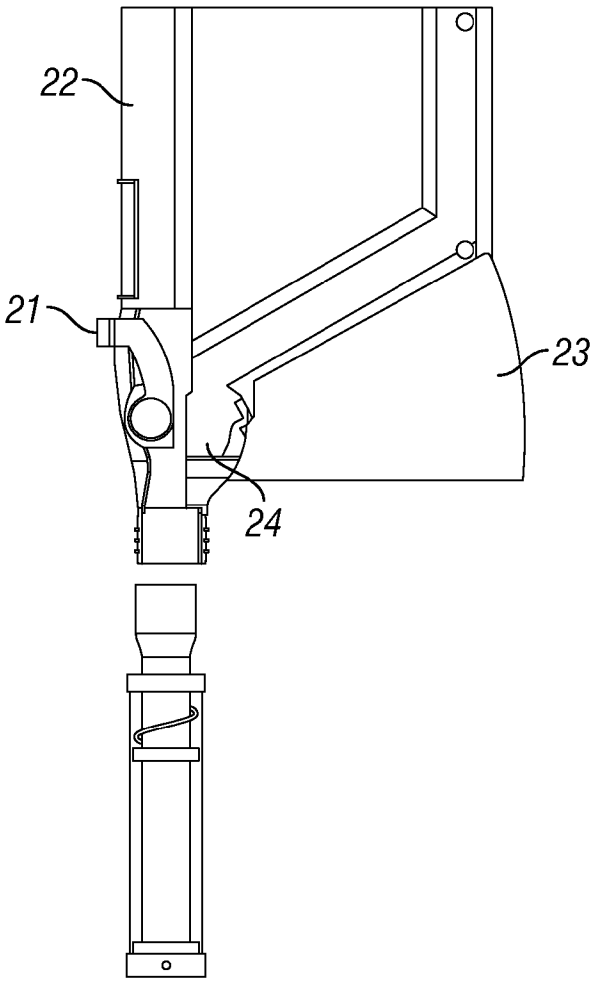
FIG. 2 is a right side view of a bulk product dispensing system of FIG. 1, in accordance with an embodiment of the present invention
Figure 1:
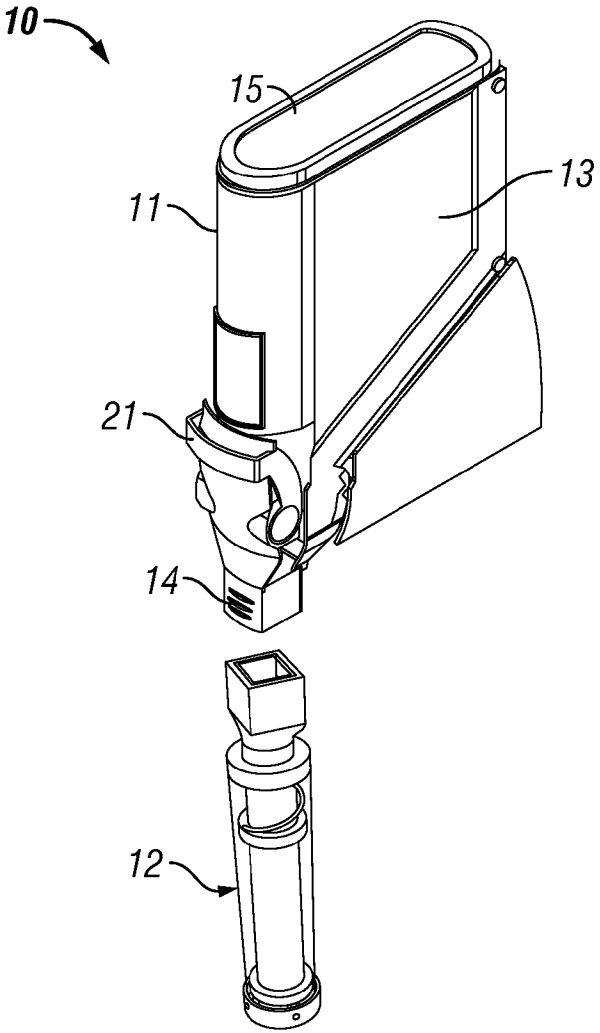
FIG. 1 is a front perspective view of a bulk product dispensing system, in accordance with an embodiment of the present invention.

Embodiments of the present invention include a unified system, device and method for bulk product dispensing in a sanitary environment to prevent micro/macro contamination, adulteration and product mix-up of dispensed products. FIG. 1 and FIG. 2 illustrate a bulk product dispensing system 10 that comprises a gravity-feed bulk product dispenser 11, a product containment bag and a secondary product containment unit 12. This system preserves the integrity and cleanliness of sensitive edible products, including foods, drugs and dietary supplements from the manufacturer to the consumer.

In an embodiment of the bulk product dispensing system 10, the gravity feed bulk product dispenser 11 comprises a hopper 13, a lid 15, a viewing/window enclosure 22, a retractable valve arm 21 and a discharge valve 14, as illustrated in FIG. 1 and FIG. 2. The visible top front or viewing enclosure 22 located on the front of the dispenser 11 allows for adequate space for a product-specific product label or a sample of a product to be easily viewable by the consumer. The slopped bottom 23 of the hopper 13 facilitates the movement of a product through the dispenser 11 towards the discharge opening 24. The retractable valve arm 21 opens and closes the exit from the discharge opening 24 of the hopper 13, allowing product to dispense through a discharge valve 14.

Figure 3B:
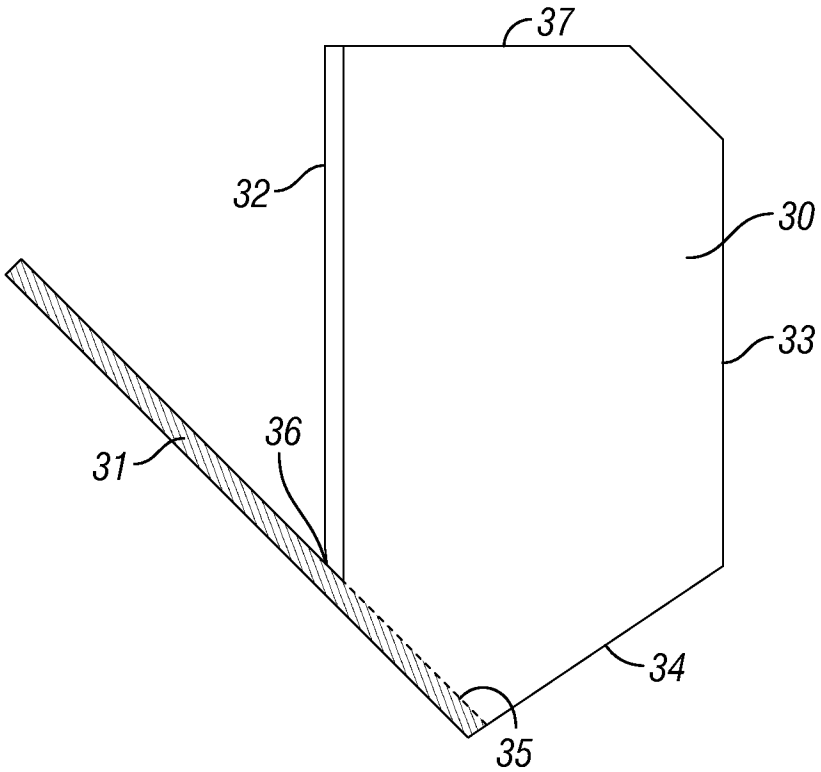
FIG. 3B illustrates a product containment bag in an unfilled state, according to an embodiment of the present invention.
Figure 3A:
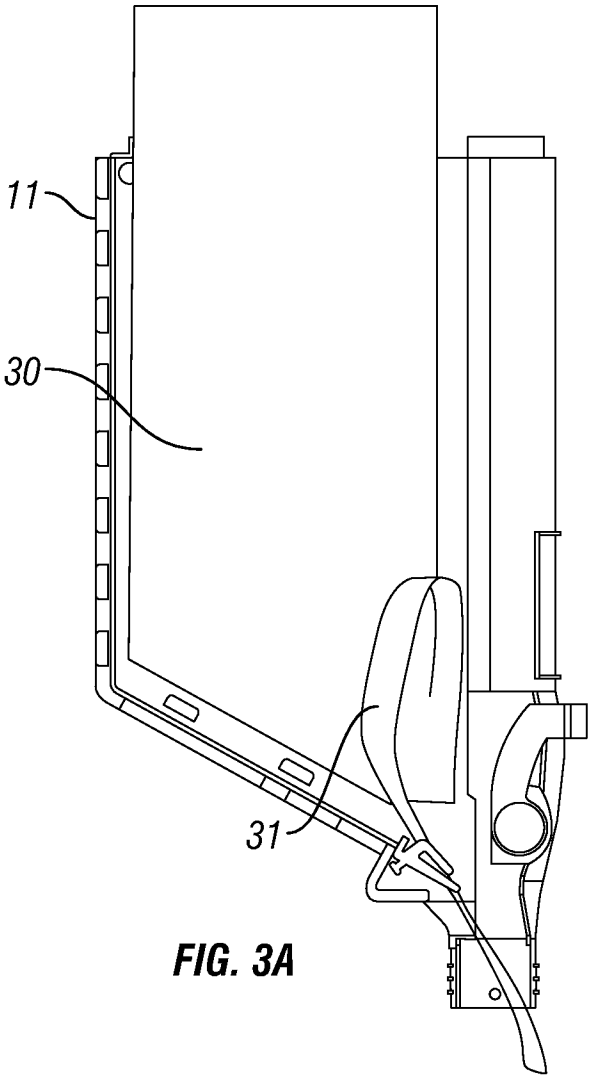
FIG. 3A is a left side view of a bulk product dispenser of the system containing a containment bag, with a left side part of the hopper removed, according to an embodiment of the present invention.

In an embodiment of the invention, the gravity feed product dispenser 11 is fit with a product container/bag/liner 30 that, when filled, conforms to the inside of the bulk product dispenser 11 as illustrated in FIG. 3A. The product container/bag 30 holds a to-be dispensed product in a moisture proof, ultraviolet light proof and air proof environment such that the product is sealed off entirely in the container/bag 30 to prevent cross-contamination, infestation, adulteration, product mix-up or exposure to the retail environment. The seals on the container/bag are configured to be tamper evident. FIG. 3A shows a left side view of the bulk product dispenser 11 of the system containing a container/bag 30, with a left side part of the hopper 13 removed. The containment bag comprises a tear-tab 31 which is threaded through the discharge valve 14 to the outside of the dispenser 11. The container/bag 30 is constructed in full compliance with 21 CFR Part 174 to 21 CFR Part 178 relating to Indirect Food Additives allowable in food packaging materials.

In one embodiment, the product containment bag 30 is constructed to line the inside of the hopper 13. The containment bag 30 comprises a long tear-tab 31, a tethered edge 32, a back edge 33, an open top edge 37, and an angled bottom 34, as shown in FIG. 3B. As shown in FIG. 3B, the tear-tab 31 is adjoined to the tethered edge 32 and can be torn away from the containment bag 30 to create a tear opening 35, thereby releasing the product for consumer dispensation. The shaded area highlights the tethered tear tab 31 and the tear opening edge 35 of the bag to be opened by pulling the tear tab 31. In one embodiment, the back edge 33, the tethered edge 32 and the angled bottom 34 are sealed or closed. In one embodiment, each seal comprises a half inch (0.5") seam. The open top edge 37, located on the top portion of the bag 30, remains open and unsealed until the containment bag 30 is filled with product.

In an embodiment of the invention, the open top edge 37 of the bag 30 is hermetically sealed at the product manufacturing site after the bag 30 is filled with product. The product bag 30 is filled product according to current dietary supplement Good Manufacturing Practices. Accordingly, the bag 30 is ready for insertion into the dispenser 11, with the product already sealed off inside the bag 30, and in such an embodiment the top edge 37 will be in a sealed condition. The hermetic seal protects the product, creating an air, moisture and light proof environment, as well as protecting against adulteration, contamination and product mix-up. In an embodiment, one or more of the bag seals are tamper evident. The containment bag 30 is engineered to approximate, when filled, the size and shape of the inside of the hopper 13.

Figure 3D:
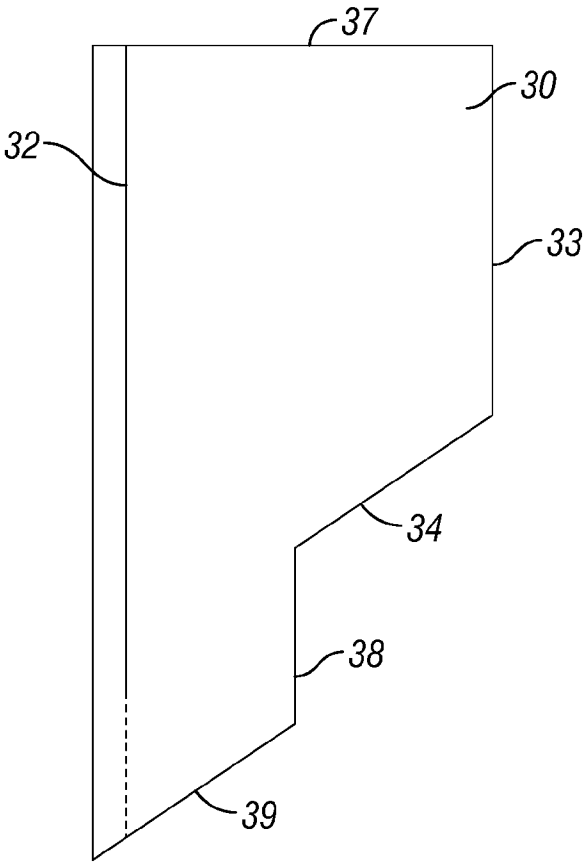
FIG. 3D illustrates a product containment bag with an extended bottom portion in an unfilled state, according to another embodiment of the present invention.

According to an embodiment, the product containment bag 30 further comprises a bottom portion that extends into the discharge opening 24 of the bulk product dispenser 11 as illustrated in FIG. 3D. In this embodiment, the containment bag 30 comprises a tethered edge 32 of forty inches (40"), a back edge 33 of sixteen inches (16"), an angled bottom 34 of nine inches (9") in height, an open top edge 37 of twenty inches (20"). It further comprises an extended portion, the extended portion with a vertical length 38 of ten inches (10") and a second angled bottom 39. The second angled bottom 39 with a width of ten inches (10") and a height of five inches (5") as illustrated in FIG. 3D. Other dimensions are possible depending on the size of the dispenser or product type.

Figure 3C:
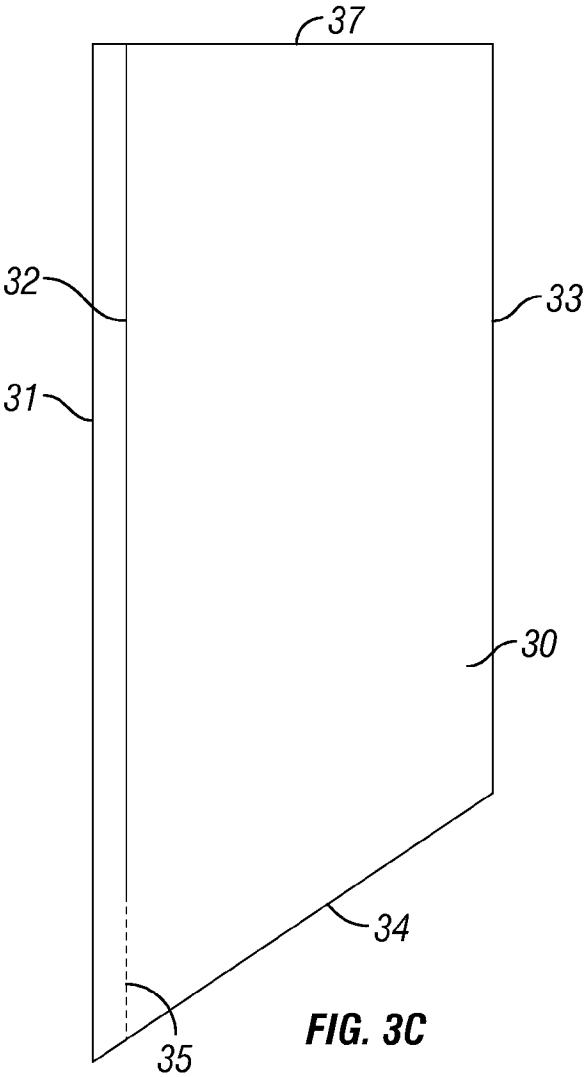
FIG. 3C illustrates a product containment bag in an unfilled state, according to another embodiment of the present invention.

In another embodiment, the product containment bag 30 comprises a tear-tab 31 that is constructed from a vertically cut strip along the edge of the bag 30, as shown in FIG. 3C. In another embodiment, the containment bag 30 is engineered to approximate the shape and size of conventional hoppers or bulk product dispensing units as known in the market.

In an embodiment of the invention, the product containment bag 30 is made of a 4 mil laminated PET/Foil/Poly barrier film, such as the PFP 400 foil barrier material or the like. The material thickness may be thinner such as with a 3 mil or 2 mil thickness. Other like foil or film barrier material that meet the requirements of good manufacturing practices (GMP) may also be used, as long as the quality of the material produced consistently meets all product specifications, and is produced in a GMP facility. For example, materials such as foil barrier material that is biodegradable, BPA free, and holds and protects a product from damaging moisture, UV light, oxygen and contamination can be used.

In an embodiment of the bulk product dispensing system 10, the tear-tab 31 of the product containment bag 30 is long enough such that the tab 31 extends and can be grasped from outside of the bulk product dispenser 11. See FIG. 3A. In one embodiment, the tear-tab 31 is approximately 16 inches and is positioned, when the containment bag 30 is placed inside the bulk product dispenser 11, to pass from the inside of dispenser 11 down through the discharge valve 14. In another embodiment, the containment bag 30 further comprises a notch 36 that is positioned along the length of the tethered edge 32 where the tethered edge 32 meets the tear-tab 31, as shown in FIG. 3B. The notch 36 facilitates the tearing and opening of the containment bag 30. The tear-tab 31 having an edge coterminous with a sealed tear opening 35 on the bag, wherein drawing on the tear-tab 31 results in tearing open the sealed tear-opening 35 and releases the product from the bag 30 into the discharge valve of the bulk product dispenser 11.

In one embodiment, pulling the tear-tab 31 from the outside of a closed bulk product dispenser 11, releases the product into the protected closed environment of the bulk product dispenser 11. Accordingly, the containment bag 30 is opened in a clean and uncontaminated manner without human hands or implements directly contacting any of the product to be dispensed. In other embodiments, the containment bag 30 is opened via a tear, puncture or bag valve in which the bag 30 is opened such that the product avoids any contact with human hands or implements.

In an embodiment of the bulk product dispensing system 10, the secondary containment unit 12 serves as an intermediate product containment, measurement and visual evaluation/inspection before the product is disgorged from the bulk product dispenser 11 into the consumer's receptacle or bag. Before release of the product to the consumer, the discharge valve 14 of the bulk product dispenser 11 is closed. This provides an enclosed environment inside the bulk product dispenser 11 to prevent contamination, adulteration, product mix-up or exposure of the product to the outside environment. The discharge valve 14 remains closed until the consumer opens it to release the product.

In one embodiment, the secondary containment unit 12 removably attaches to the discharge valve 14 of the bulk product dispenser 11, as illustrated in FIG. 1. The secondary containment unit 12 comprises a funnel 41, an inner product compartment/containment portion 42 and an outer mechanism portion 43 as illustrated in FIGS. 4A, 4B and 4D.

In one embodiment, the secondary containment unit 12 attaches to the discharge valve 14 by inserting the discharge valve 14 into the funnel 41. The funnel 41 is constructed such that it fits around the outer surface of the discharge valve 14, the throat, such that an open pathway is formed from the valve 14 through the funnel 41 into the inner containment portion 42 of the secondary containment unit 12. The secondary containment unit 12 is secured in place with a pin inserted and fitted horizontally through the walls of the throat of the funnel/discharge valve connection. Securing means such as a screw, cotter pin, or shaft assembly, or others mechanisms as known in the art may also be used.

In an embodiment of the invention, the inner product containment portion 42 of the secondary product containment unit 12 receives the dispensed product from the discharge valve 14 of the bulk product dispenser 11, while the outer mechanism portion 43 serves to release the product to the consumer. The inner containment portion 42 comprises an inner tube 50, a top doughnut 51 (coupling) and a bottom doughnut 52 (coupling) as illustrated in the partial view of FIG. 5D.

Figure 4C:
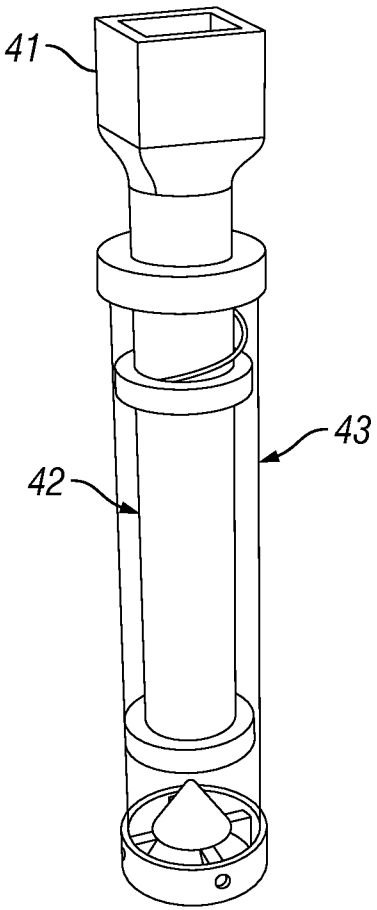
FIG. 4C is a perspective view of the secondary product containment unit of the system of FIG. 1 in an open position, according to an embodiment of the present invention.
Figure 4B:
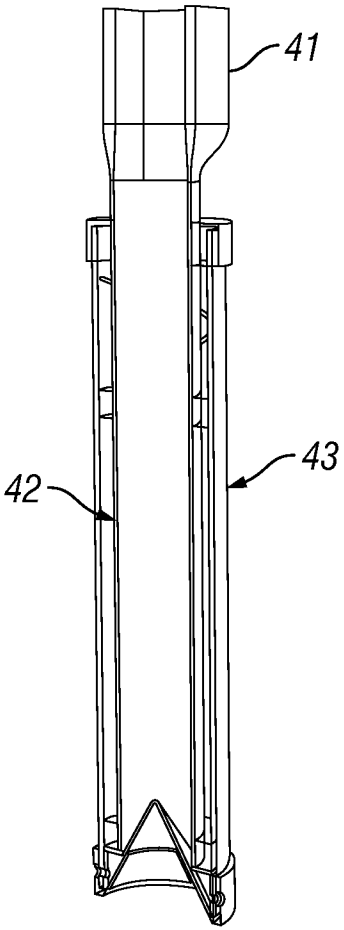
FIG. 4B is a cross-sectional view of the secondary product containment unit of the system of FIG. 1 in the closed position, according to an embodiment of the present invention.
Figure 4A:
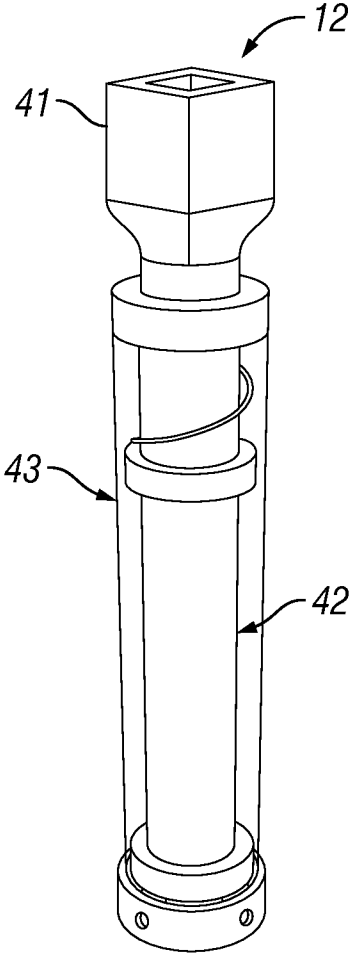
FIG. 4A is a perspective view of the secondary product containment unit of the system of FIG. 1 in a closed position, according to an embodiment of the present invention.
Figure 5A:
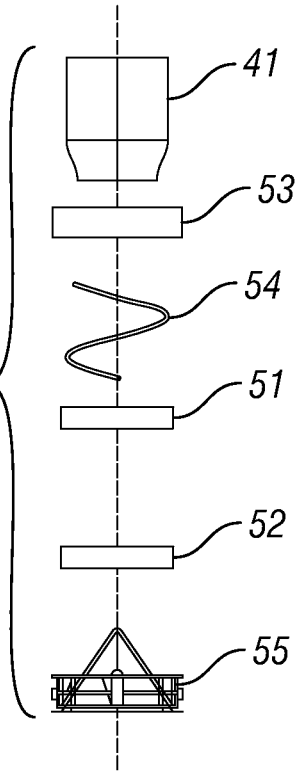
FIG. 5A is an exploded side view of part of the secondary product containment unit, according to an embodiment of the present invention.
Figure 5B:
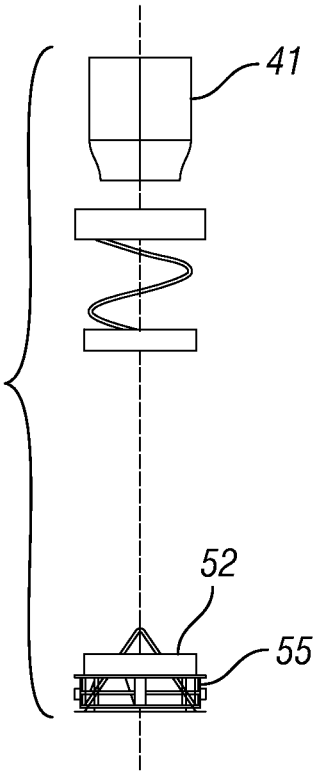
FIG. 5B is an exploded side view of part of the secondary product containment unit in a closed position according to an embodiment of the present invention.
Figure 5C:
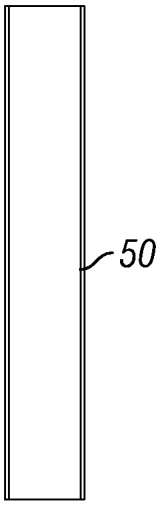
FIG. 5C is a side view of the inner tube of the secondary product containment unit of the device, according to an embodiment of the present invention.
Figure 5D:
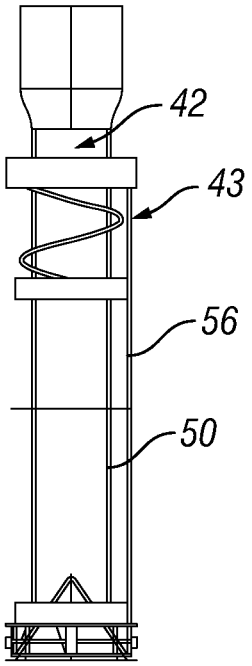
FIG. 5D is a side view of part of the secondary product containment unit in a closed position with the inner tube, according to an embodiment of the present invention.

The inner tube 50 as illustrated in FIG. 5C, in a closed position, as further shown in FIGS. 4A, and 4B, provides intermediate containment of the product in an enclosed and protected environment. The inner tube 50 is attached to the exiting end of the funnel 41, and is fitted with the top doughnut 51 along the length of the tube, and the bottom doughnut 52 at the exiting end of the tube 50, as illustrated in FIGS. 5D and 6D. The inner tube 50 runs continuously from the funnel 41 through the containment unit to terminate with the bottom doughnut 52. Product released from the bulk product dispenser 11 is held in the inner containment portion 42 of the secondary containment unit to be measured and finally dispensed to the consumer.

In an embodiment of the invention, the inner containment portion 42 further comprises vertical lines to measure the amount of dispensed product. The lines are calibrated based on product type, to allow consumers to visually evaluate/inspect and adjust the amount of product dispensed by each release or pull of the retractable value arm 21, before the product is dispensed into the consumer provided receptacle.

In an embodiment of the invention, the outer mechanism portion 43 comprises a spring-loaded outer-tube 56 that opens and closes the dispensing exit of the secondary containment unit 12. FIGS. 5A-5D and the corresponding perspective views of FIGS. 6A-6D illustrate the components of the secondary containment unit 12. As illustrated in the exploded view of FIGS. 5A, 5B, 6A, 6B, parts of the inner containment portion are shown without the inner tube 50, along with parts of the outer mechanism 43 components. The mechanism 43 comprises a cap 53, a spring 54, a bottom end closure 55 having a protruding surface, for example a cone shape, and the outer tube 56 as illustrated in FIGS. 5A, 5B, 5D and 6A, 6B and 6D. The circumference of the outer tube 56 is larger than the inner tube 50, such that the inner containment portion 42 slides easily within the outer tube 56. The cap 53 is attached to the top of the outer tube 56 and the end closure 55 is attached to the opposing end of the outer tube 56. A spring 54 positioned between the cap 53 and the upper surface of the top doughnut 51, which provides upward vertical resistance against the cap 53, such that secondary containment unit 12 remains in a closed position, as illustrated in FIGS. 4A, 5D and 6D.

Figure 6A:
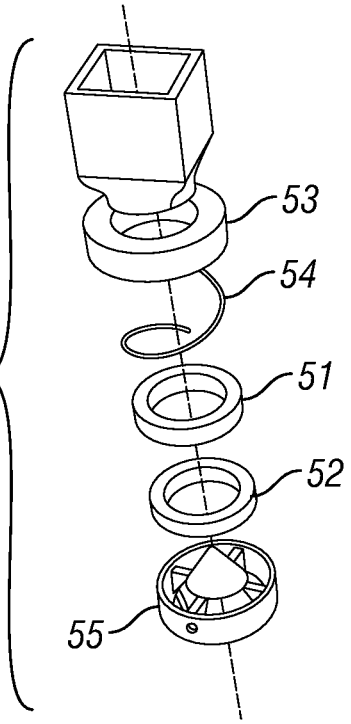
FIGS. 6A-6D show corresponding perspective views of FIGS. 5A-5D, according to embodiments of the present invention.
Figure 6B:
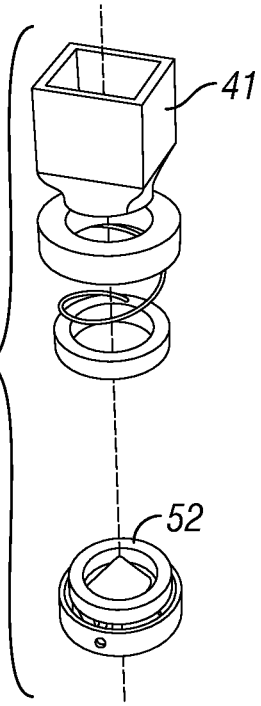
Figure 6C:
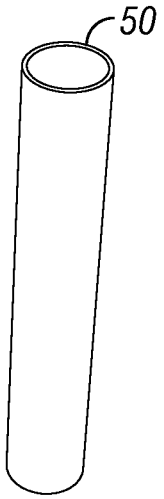
Figure 6D:
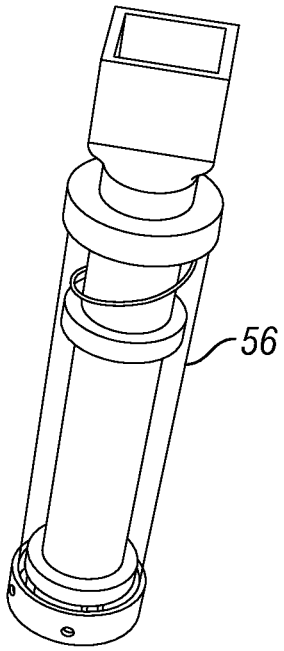

In the closed position, the bottom doughnut 52 is positioned on top of the end closure 55, as shown in FIGS. 4A, 5B, and 6B, and closes off the exit of the secondary containment unit 12, preventing product from dispensing out. The secondary containment unit 12 remains closed until a consumer opens it by pulling or applying a downward vertical force on the outer mechanism portion 43. FIG. 4C illustrates the position of the containment unit when pulled/engaged. As shown, the outer mechanism portion 43 is forced downward, compressing the spring 54 against the top doughnut 51, thereby displacing the inner containment portion away from the end closure 55. The top of the inner tube 50 is thereby displaced upward from the cap 53 as it is coaxially situated through the cap 53. Upon opening, the secondary containment unit 12 disgorges the product that in contained in the inner containment portion 42 as the bottom doughnut 52 is displaced away from the end closure 55. After the product is dispensed, the consumer releases the outer mechanism portion 43 and the end closure 55 returns to the closed position due to the spring action between the cap 53 and top doughnut 51. Once the secondary containment unit 12 is back in the closed position, it is prepared to accept more product from the bulk product dispenser 11.

Figure 7D:
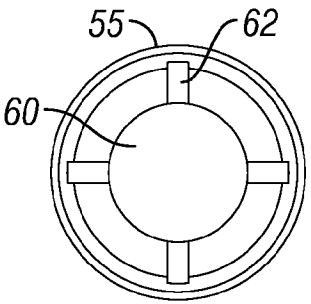
FIG. 7D is a top view of the bottom end closure of a secondary product containment unit, according to an embodiment of the present invention.
Figure 7E:
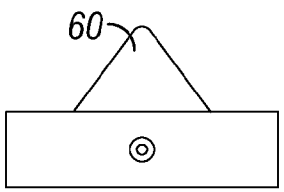
FIG. 7E is a side view of the bottom end closure of a secondary product containment unit, according to an embodiment of the present invention.
Figure 7A:
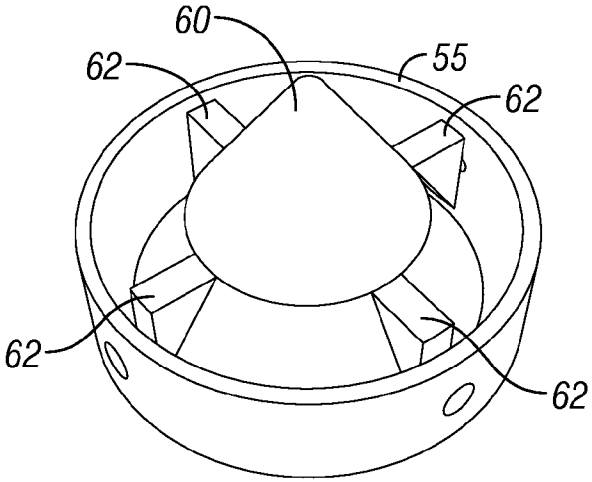
FIG. 7A is an enlarged perspective view of the bottom end closure of a secondary product containment unit, according to an embodiment of the present invention.

As illustrated in FIGS. 7A-7E, the end enclosure 55 is further depicted with a vertically protruding surface 60 and surrounded by one or more apertures. In FIG. 7A, the perspective view of end closure 55 comprises a protruding cone surface 60 in the middle of the closure, and is surrounded by a plurality of ribs 62 extending between the cone surface outer edge to the inner surface of the wall of the closure 55, where the ribs 62 define a plurality of alternating apertures. As shown in this embodiment, there are four ribs defining four apertures. According to an embodiment, each of the ribs 62 is shown as a triangular configuration having a short gap between the inner edge of the wall of the closure 55 to the outer edge of the rib. In other embodiments, the ribs are formed in other shapes such as a straight arms that are continuously molded piece with the protruding cone surface, without any gap between the rib and the wall of the closure 55, as long as an aperture is formed between the ribs.

Figure 7B:
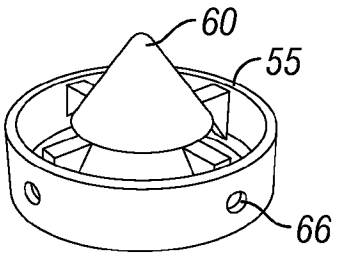
FIG. 7B is another perspective view of the bottom end closure of a secondary product containment unit, according to an embodiment of the present invention.
Figure 7C:
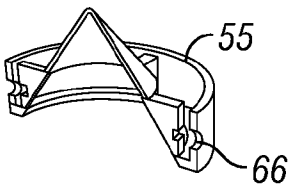
FIG. 7C is a cross-sectional perspective view of the bottom end closure of a secondary product containment unit, according to an embodiment of the present invention.

As shown in FIG. 7B and FIG. 7C, aligned with each rib 62 is an opening 66 running through the wall of the closure 55. The end closure 55 is attached to outer tube 56 through a connection, such as screw connection through opening 66, by fitting the outer tube edge, into the gap between the wall of the closure and the ribs. In other embodiments, the opening 66 may be located on other areas of the wall of the 55, not necessarily aligned with the rib 62. The widest diameter of the cone surface 60 fits to engage in to the open inner diameter of the inner tube 50 when in the closed position. Accordingly, the apertures between the ribs 62 are sealed off by the second coupling 52 resting against the closure 55 when in the closed position. When the containment unit 12 is engaged to discharge the product, outer tube 56 is forced downward, thereby displacing the closure 55 from the second coupling 52, such that product falls through the apertures between the ribs of the closure. The protruding cone surface 60 ensures that all the product falls through the apertures, directing the product to fall to sides of the cone surface 60 such that it does not remain or get stuck on the cone surface 60.

Figure 8:
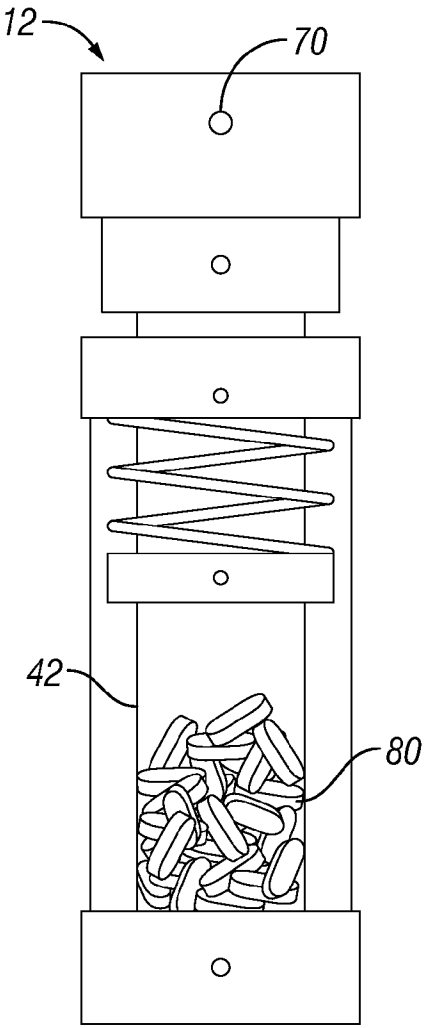
FIG. 8 is a perspective view of a secondary product containment unit holding a product, according to an embodiment of the present invention.

FIG. 8 further illustrates the containment unit with a to-be-released product 80, according to an embodiment of the present invention. The product 80 is shown contained in the inner tube 50 of the inner containment portion 42. The surface of the inner containment portion 42 having a measuring/calibration/evaluation means to determine the level of and evaluate the product 80 dispensed. The surface material allowing for the product 80 to be seen through the surface to visually gauge the amount of product dispensed which varies by product. The surface may have stacked lines to measure the volume level of product 80. In another embodiment, the measuring means comprising a visual indicator of the product to be dispensed in the form of an identifying glyph or logo or name to further provide visual confirmation to the dispensing consumer that the product to be dispensed is the desired product. At the top of the containment unit 12, the funnel 41 comprises a pin hole 70 for attaching the containment unit to the dispenser valve. Such attachment can be secured via a pin through hole 70 and a hitch pin clip connection.

In an embodiment of the invention, the secondary containment unit 12 is constructed from BPA-free acetyl and BPA-free acrylic. The inner tube 50 being transparent, translucent or see-through to allow for visual determination of the volume of product dispensed into the secondary containment unit 12.

In another embodiment of the bulk product dispensing system 10, a conventional dispenser is used with the containment bag 30 and secondary containment unit 12 to contain and dispense product that is protected from contaminants, adulteration, product mix-up and the retail environment.

In another embodiment of the invention, the bulk product dispensing system comprises a dispenser fitted with a containment bag 30 and a secondary containment unit 12. In this embodiment, the dispenser may be of a paperboard, a plastic or a metal construction. Some examples include a dispenser in the form of a cardboard box, plastic jug or metal can. In another embodiment, the dispenser may be any type of sturdy material that will hold product.

In another embodiment of the invention, the product container/bag 30 and the secondary product containment unit 12 are used to dispense product that is protected from contaminants, adulteration, product mix-up and the retail environment, without the product container/bag 30 further residing in a dispenser. In this embodiment, the container/bag 30 is reinforced and constructed with a valve and a tear seal such that the container/bag 30 is itself attached to and fitted with the secondary containment unit 12. In this embodiment, product is dispensed from the container/bag 30 into the secondary containment unit 12 without the use of a bulk product gravity feed dispenser 11 or any other type of dispenser.

In another embodiment of the present invention, the containment bag 30 is filled with product by a product manufacturer. The bag 30 is then hermetically sealed to protect the product from micro and macro contamination. The product filled containment bag 30 is then placed into the bulk product dispenser 11 where it is protected from the retail environment by the enclosed space created by the hopper 13, the lid 15, and the closed valve arm 21.

In an embodiment of the invention, the sealed containment bag 30 is filled with product and inserted into the covered hopper 13 and the long tear-tab 31 is fed through the discharge valve 14 to the outside of the dispenser 11. The containment bag 30 is then opened and the product released into the bottom throat of the closed bulk product dispenser 11 by pulling on the tear-tab 31. Releasing the product into the closed environment of the bulk product dispenser 11 prevents the product from coming into contact with implements or human hands or being exposed to the retail environment.

The product is then released from the bulk product dispenser 11 by opening the retractable valve arm 21. After the product moves through the discharge opening 24, it continues to fall through the discharge valve 14 and funnel 41 into a closed secondary containment unit 12. Movement of the product from the closed bulk product dispenser 11 and sealed containment bag 30 into a closed secondary containment unit 12 protects the product from micro and macro contamination, adulteration and product mix-up from the outside and retail environment.

After some product is released and measured in the secondary containment unit 12, more product can be released from the bulk product dispenser 11 until the desired amount is released. When the desired amount has been released into the secondary containment 12, the outer mechanism 43 is opened to dispense the desire amount of product into the consumer's bag or receptacle. After all the product is dispensed, the spring-loaded outer mechanism 43 closes and returns the bulk product dispensing system 10 to a closed environment.

In a further embodiment, a funnel or other directing device for assisting in release of product from the secondary containment unit 12 to the consumer, is removably attached to the exit bottom of the secondary containment unit. The funnel is configured to direct disgorgement of the product into the consumer's receptacle such as a bag or bottle. The funnel is manually operable for single handed connection to the exit of the secondary containment unit 12. Such connection includes either the top of the funnel engaging the inside of the exit of the secondary containment unit or alternatively sliding around the outer circumference of the exit of the secondary containment unit.

In an embodiment, the containment bag 30 of the present invention serves to keep the product in an uncontaminated state such that the product is released directly from the bag 30 into the discharge valve 14 of a dispenser. Accordingly, a configuration of the system in which the bag 30 is used with a conventional dispenser in which the bag is opened from outside the dispenser, once it is placed inside the dispenser, diminishes contamination and infestation potential where product is intended to be directly released into a consumer's receptacle.

According to another embodiment of the present invention, there is disclosed a method for gravity fed bulk product dispensing using a bulk product dispensing system. The method includes standard operating procedures in compliance with the Federal Drug Administration Good Manufacturing Practice for Drugs (21 CFR Parts 201, 210 & 211), Good Manufacturing Practices for Dietary Supplements (21 CFR Part 111) and Good Manufacturing Practices for Foods (21 CFR Part 110), as well as well as 21 CFR Part 174 to 21 CFR Part 178 regulations relating to Indirect Food Additives allowable in food packaging materials and Hazard Analysis Critical Control Point (HACCP) regulations embodied in state and local health regulations. According to a method for bulk product dispensing, the method comprises a dispenser connected to a secondary containment unit for dispending a product, the method comprising: loading the dispenser with product sealed within a containment bag or liner wherein the containment bag is made of protective material against moisture, ultra violet light and air and having a quick release tear tab with a tethered strip; threading the tethered strip of the containment bag through a dispensing valve of the dispenser; attaching the secondary containment unit to the discharge valve; pulling the tethered strip to release the tear tab allowing product to release from the bag into the dispenser in a safe and uncontaminated environment; engaging the discharge valve to dispense and measure product into the containment unit as the containment unit is in a closed state; after releasing the discharge valve of the dispenser such that the dispenser is in a closed off state, engaging the containment unit to release the product to a consumer.

According to another embodiment, the dispenser comprises one or more cleaning or sanitizing wipes and a compartment on the dispenser for holding the one or more cleaning/sanitizing wipes. In another embodiment, the containment bag comprises one or more cleaning or sanitizing wipes and a compartment on an outside surface of the containment bag for holding the one or more cleaning/sanitizing wipes. The wipes are useful for cleaning the inside of the dispenser, including the mouth and valve of the dispenser, in between replenishment of new product lot numbers. Such sanitizing step provides for clean standard operating procedures, protecting a dispensed product from contamination for the consumer, by cleaning away debris, residual product, and other unwanted residue. The compartment may form a discrete and relatively flat pouch to easily hold and allow for easy retrieval of the one or more disposable sanitizing wipes. The compartment may be partly exposed for easy access or provide a complete containment of the wipes requiring the compartment to be opened before reaching the wipes. In another embodiment, a compartment may be adhered to the inner surface of the product containment bag to hold a desiccant and/or antioxidant sachet; which compartment may be of an open web-like or mesh material to allow for adequate air flow to allow the desiccant and/or antioxidant sachet to function properly.

According to another embodiment, the product dispenser comprises a labeling device for real time label extrusion from the dispenser for the consumer to obtain on the receptacle/bottle for receiving the dispensed product. The label including details of the product being dispensed from the product dispenser including but not limited to information regarding the product composition, features, advantages, or warnings. The product disperser comprising an opening on the outside surface of the front of the product dispenser through which the label is emitted. The label provides a final confirmation for the consumer that the product dispensed and received is the same as the product indicated on the primary product dispenser label, and also adheres to a consumer's take-away bag or receptacle to allow for future identification of the product. The labels are held in a roll of labels on the inside of the dispenser bin, resting on top of the product containment bag, and fed through a narrow horizontal slit at the bottom of the product label viewing area 22, see FIG. 1A.

The disclosed system, device, components, and methods are in compliance with and governed by the Federal Drug Administration Good Manufacturing Practice for Drugs (21 CFR Parts 201, 210 & 211), Good Manufacturing Practices for Dietary Supplements (21 CFR Part 111) and Good Manufacturing Practices for Foods (21 CFR Part 110), as well as well as 21 CFR Part 174 to 21 CFR Part 178 regulations relating to Indirect Food Additives allowable in food packaging materials and Hazard Analysis Critical Control Point (HACCP) regulations embodied in state and local health regulations. They provide retailers and consumers a safe and effective way to dispense products, free from micro and macro contamination and infestation, and further assures of a product's identity, purity, strength and composition. The disclosed embodiments of the invention have a compliance with such regulations that further reduces packaging materials and thereby supports a more cost effective way to dispense such products. The invention embodiments are further in compliance with related standards including the Hazard Analysis and Critical Control Point Systems (21 CFR Part 120); Food and Dietary Supplement Labeling (21 CFR Part 101); Permitted Indirect Food Additives (21 CFR Parts 174 to 178 and 21 CFR Part 189); and Requirement for Authorized Dispensers & Pharmacies (21 CFR Parts 208 and 209).

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments or alternatives of the foregoing description.

I claim:

1. A gravity feed bulk product dispensing system comprising:

a bulk product dispenser comprising a discharge valve at a bottom of the dispenser;

a product container configured for holding and protecting a product from damaging moisture, ultra violet light, contamination and adulteration, the container constructed to fit, in a product-filled state, inside of the dispenser, wherein the container further comprises a tear-tab extending from a bottom of the container, the tear-tab having an edge coterminous with a sealed tear opening on the container, wherein drawing on the tear-tab opens the tear opening and releases the product into the dispenser and directed toward the discharge valve; and a secondary containment unit having an entrance, the entrance adapted to removably attach to the discharge valve, wherein the secondary containment unit further comprises a funnel extending from the entrance, a tubular inner compartment connected to the funnel that receives the product dispensed through the discharge valve and funnel, the inner compartment further comprising a measuring means to measure and visually inspect the product received, and a spring loaded exit valve for disgorging the product.

2. The system of claim 1, wherein the tear-tab has a length extending out through the discharge valve to outside of the dispenser.

3. The system of claim 1, wherein the measuring means is a visual indicator on a surface of the inner compartment calibrated to measure a volume of the product dispensed into the secondary containment unit.

4. The system of claim 1, wherein the secondary containment unit further comprising a bottom coupling attached to a bottom of the inner compartment, a top coupling attached toward a top section of the inner compartment; and wherein the spring loaded exit valve further comprises an outer tube, a cap, a spring, and a bottom closure, wherein the outer tube is positioned between the cap and the bottom closure, the outer tube surrounds the inner compartment, bottom coupling, top coupling, and spring;

the spring having a diameter less than a diameter of the top coupling and larger than a diameter of the inner compartment, the spring positioned around the inner compartment between the top coupling and the cap, such that when the spring is compressed, the outer tube, the cap and the bottom closure move relative to the inner compartment, top coupling and bottom coupling;

the bottom closure aligned against the bottom coupling of the inner compartment when the secondary containment unit is in a closed position, retaining product in the inner compartment;

the spring loaded exit valve operated upon with a force placed on the outer tube to compress the spring, displacing the bottom closure from the bottom coupling, releasing the product.

5. The system of claim 4, wherein the bottom closure of the exit valve has a conical middle surface having a diameter aligned to fit into an inner diameter of the bottom coupling, closing off the exit valve when engaged, and the bottom closure further comprising one or more apertures surrounding the conical middle surface, the one or more apertures having a size configured to have product fall through the one or more apertures when the bottom closure is displaced from the bottom coupling.

6. The system of claim 4, further comprising a pin assembly to secure the dispenser and entrance of the secondary containment unit together;

wherein when the discharge valve is opened, the containment unit is in a closed state, product is released from the dispenser through the funnel into the containment unit; and when the discharge valve is closed, the exit valve of the containment unit is operable by a force to release the product, wherein the exit valve retracts to a closed position upon release of the force.

* * * * *